United States Patent [19]

Bruton

[11] Patent Number: 4,671,312

[45] Date of Patent: Jun. 9, 1987

[54] WIRELINE CUTTING ACTUATOR AND VALVE

[75] Inventor: Billy R. Bruton, Longview, Tex.

[73] Assignee: Axelson, Inc., Longview, Tex.

[21] Appl. No.: 827,201

[22] Filed: Feb. 3, 1986

Related U.S. Application Data

[63] Continuation of Ser. No. 610,263, May 14, 1984, abandoned.

[51] Int. Cl.[4] ..... F16K 51/00

[52] U.S. Cl. ..... 137/315; 251/63.6; 251/327

[58] Field of Search ..... 251/60, 63.5, 63.6, 251/62, 327, 193, 195, 206, 326; 92/138; 137/315

[56] References Cited

U.S. PATENT DOCUMENTS

| | | | |
|---|---|---|---|
| 1,613,509 | 1/1927 | Gill | 251/123 |
| 2,601,304 | 6/1952 | Lane | 251/206 |
| 2,694,545 | 11/1954 | Steenbergh | 251/63.5 |
| 2,994,344 | 8/1961 | Kerley | 251/206 |
| 3,026,081 | 3/1962 | Rossi | 251/14 |
| 3,046,802 | 7/1962 | Cupedo | 251/62 |
| 3,115,330 | 12/1963 | Dollison | 251/63.6 |
| 3,183,926 | 5/1965 | Boudot | 137/315 |
| 3,253,611 | 5/1966 | Cummins | 251/14 |
| 3,290,003 | 12/1966 | Kessler | 251/63.6 |
| 3,294,112 | 12/1966 | Watkins | 251/206 |
| 3,378,224 | 4/1968 | Boyle | 251/63.6 |
| 3,385,561 | 5/1968 | Whale | 251/14 |
| 3,610,574 | 10/1971 | Hartman | 251/326 |
| 3,729,168 | 4/1973 | Natho et al. | 251/63.6 |
| 3,789,875 | 2/1974 | McGee | 251/63.6 |
| 3,958,493 | 5/1976 | Fujita et al. | 92/13.8 |
| 3,958,592 | 5/1976 | Wells et al. | 251/63.6 |
| 3,993,284 | 11/1976 | Lukens, Jr. | 251/63.6 |
| 4,135,547 | 1/1979 | Akkerman et al. | 251/63.6 |
| 4,187,870 | 2/1980 | Akkerman | 251/63.6 |
| 4,199,131 | 4/1980 | Boski et al. | 251/62 |
| 4,304,393 | 12/1981 | Malysheu et al. | 251/327 |
| 4,316,482 | 2/1982 | Pearce et al. | 137/315 |
| 4,335,744 | 6/1982 | Bey | 251/63.5 |
| 4,354,425 | 10/1982 | Bruton et al. | 92/94 |
| 4,354,663 | 10/1982 | Vanderburg et al. | 251/210 |
| 4,402,337 | 9/1983 | Schuurman | 251/195 |
| 4,423,748 | 1/1984 | Ellett | 251/63.6 |
| 4,434,967 | 3/1984 | Vanderburg | 251/327 |
| 4,506,865 | 3/1985 | Bragin et al. | 251/326 |

OTHER PUBLICATIONS

Baker CAC—Wellhead and Production Actuators p. 572, 1980–1982, Composite Catalog.

*Primary Examiner*—Samuel Scott
*Assistant Examiner*—H. A. Odar
*Attorney, Agent, or Firm*—Hubbard, Thurman, Turner & Tucker

[57] ABSTRACT

Disclosed is a wireline cutting actuator and valve assembly. The valve includes a valve body having a gate reciprocatingly mounted therein. The gate has a stepped bore. The actuator includes a bonnet adapted for connection to the valve body and an actuator shaft having an inner end adapted for connection to the valve member. The actuator shaft extends outwardly of the bonnet. An actuator housing is releasibly connected to the bonnet and positioned about the actuator shaft. A spring is provided for urging the actuator shaft outwardly with respect to the bonnet. A piston housing assembly is releasibly connected to the actuator housing. A piston is slidingly mounted in the piston and is abuttable with the outer end of the actuator shaft to urge the actuator shaft inwardly with respect to the bonnet. A piston shaft is inwardly and outwardly movable with the piston and extends outwardly of the piston housing.

12 Claims, 6 Drawing Figures

WIRELINE CUTTING ACTUATOR AND VALVE

This application is a continuation, of application Ser. No. 610,263, filed 5-14-84, now abandoned.

BACKGROUND OF THE INVENTION

A. Summary of the Invention

The present invention relates generally to valves and valve actuators, and more particularly to a valve and actuator that is adapted for automatic shut in during wireline operations.

B. Description of the Prior Art

Valve and actuator combinations are used extensively in various fluid handling systems. For example, valve and actuator combinations are a primary component of surface safety systems used in the control of oil or gas production. Such valve and actuator combinations typically include a gate type valve, which includes a gate having a port and an imperforate portion, which is movable within a valve body between an open position wherein the port is aligned with the valve inlet and outlet, and a closed position wherein the imperforate portion is sealingly interposed between the inlet and the outlet. The actuator in such systems typically includes an actuator stem, which is connected to for reciprocation with the valve gate, and a piston or the like, which is connected to the stem and which is reciprocatingly mounted in a cylinder. Normally, the piston is actuated in one direction by pneumatic or hydraulic pressure to hold the valve in either the open or the closed position, and by spring or internal valve body pressure to the other of the open or closed positions.

Surface safety systems, which include valve and actuator combinations, are commonly used in well heads or christmas trees through which wireline operations are conducted. In wireline operations, various tools are run from the surface into and out of the well by means of a wire. The type of wire used is dependent upon the type of tool that is being used; however, all of the various types and sizes of wire are strong and very durable.

During wireline operations, it is necessary that the safety system that controls the well not be disabled or otherwise rendered inoperative. In other words, it is necessary that the safety valve be able to close to shut in the well when wireline operations are being conducted.

There have been developed a number of wireline cutting actuators for use in combination with surface safety valves. The wireline cutting actuators are designed to provide sufficient closing force, even in the absence of valve body pressure, to shear the wireline and allow the valve to move to the fully closed position. Since the wires used in wireline operations are so durable, very high forces are needed in order to shear the wire. Accordingly, wireline cutting actuators typically are large massive unitary structures that include tremendously strong springs. Such actuators are bulky and hard for workmen to service. More specifically, presently existing actuator designs require normally the length of the actuator for clearance from 30 inches to 50 inches and/or that special tools and special handling equipment be required to move the entire actuator and spring assembly as one massive unit. Usually, two or more persons are required to remove such actuators. The total time required to remove, service, and reinstall such actuator equipment can amount to several hours and require substantial working space and equipment clearance. An example of a presently existing wireline cutting actuator is the Baker CAC Model WC wire cutting hydraulic actuator, which is illustrated at page 572 of the 1982–83 Composite Catalog.

It is an object of the present invention to provide a wireline cutting actuator and actuator valve combination that overcome the shortcomings of the prior art. More specifically, it is an object of the present invention to provide a wireline cutting actuator that may be assembled and disassembled easily and quickly by one person using standard, readily available tools.

It is a further object of the present invention to provide an actuator that may be disassembled with a minimum of clearance.

It is a further object of the present invention to provide an actuator with a light weight easily removable piston housing assembly that permits simple replacement of the seal components during servicing.

It is a further object of the present invention to provide a wireline cutting actuator that has a separate spring assembly which is not affected by the assembly or disassembly of the piston housing assembly.

It is a further object of the present invention to provide a valve that reduces the force necessary to cut a wireline and which prevents the formation of wire fragments within the valve body.

SUMMARY OF THE INVENTION

The foregoing and other objects are accomplished by the actuator and valve of the present invention. The valve includes a valve body having an inlet port and an outlet port with a flowway therebetween. First and second axially aligned spaced apart first and second annular seats are positioned in the flowway, with one of the seats having a larger inside diameter than the other seat. A gate is positioned between the seats. The gate includes a bore and an imperforate portion, with the gate being movable generally perpendicular to the flowway between a valve closed position wherein the imperforate position is positioned between and in sealing engagement with at least one of the seats and a valve opened position wherein the bore is positioned between an in alignment with the seats. The bore is stepped such that its diameter adjacent the larger diameter seat is larger than its diameter adjacent the smaller diameter seat. Thus, as the gate moves from the valve open to the valve closed position, the smaller diameter of the bore passes its adjacent seat before the larger diameter passes its adjacent seat. The valve also includes a bonnet having a bonnet bore, which is connected to the valve body. An actuator shaft having an inner end connected to the gate extends outwardly of the bonnet through the bonnet bore.

The actuator includes a tubular actuator housing releasably connected to the bonnet to extend outwardly therefrom about the actuator shaft. A spring, which preferably comprises a plurality of Bellville washers stacked about the actuator shaft, is positioned to urge the actuator shaft outwardly with respect to the bonnet. The actuator includes a piston power assembly. The piston power assembly includes a piston housing releasably connected to the actuator housing and a piston slidingly mounted in the piston housing and abuttable with the outer end of the actuator shaft to urge the stem inwardly with respect to the bonnet.

DESCRIPTION OF THE PREFERRED EMBODIMENT

Figure 1:
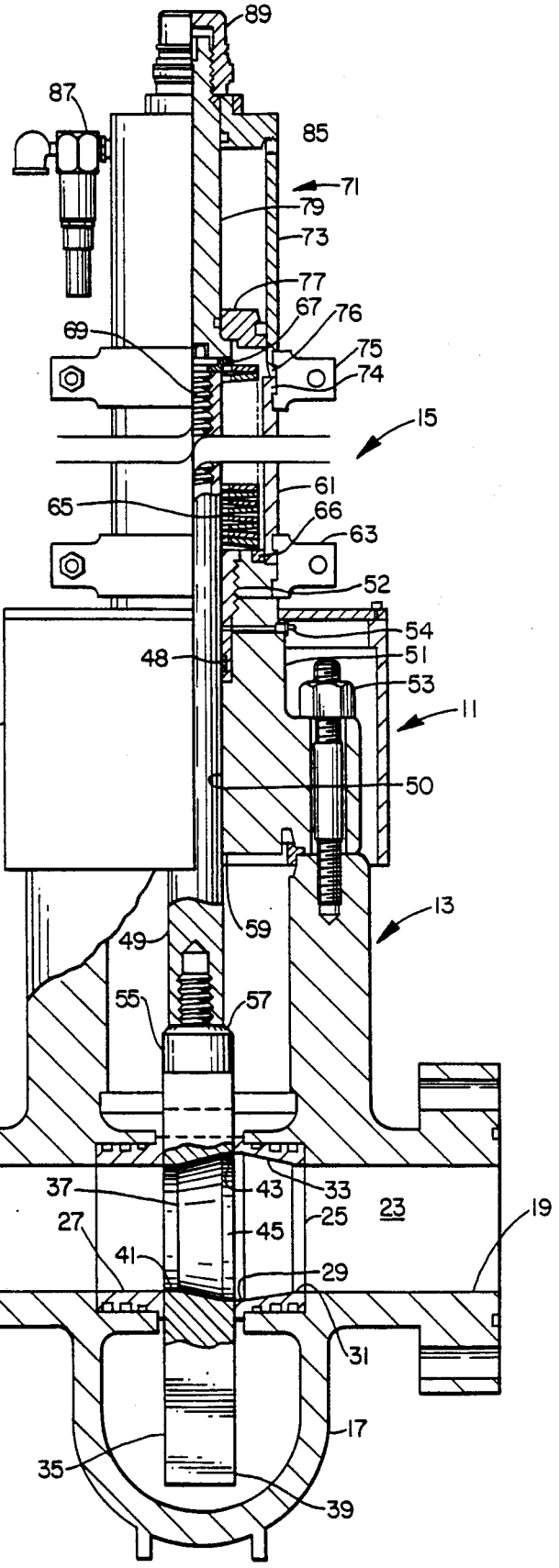
FIG. 1 is a quarter sectional view of the valve and actuator assembly of the present invention.

Referring now to the drawings, and first to FIG. 1, the valve and actuator combination of the present invention is designated generally by the numeral 11. Combination 11 includes a valve, designated generally by the numeral 13, and an actuator, designated generally by the number 15.

Valve 13 includes a valve body 17 having an inlet 19 and an outlet 21 with a flowway 23 therebetween. Valve 13 is adapted for connection in a fluid flow conduit at inlet 19 and outlet 21 by means of flanges or the like.

Valve 13 includes an upstream seat 25 mounted in valve body 17 and an axially spaced apart downstream seat 27. In the preferred embodiment, downstream seat 27 has a uniform inside diameter. However, upstream seat 25 has a stepped inside diameter which includes an enlarged diameter portion 29 and a reduced diameter portion 31 with a frustoconical portion 33 therebetween.

Valve 13 includes a gate 35 mounted within valve body 17 between seats 25 and 27. Gate 35 includes a bore 37 and an imperforate portion 39. Valve 13 is illustrated in FIG. 1 in the open position wherein bore 37 is positioned between seats 25 and 27. Gate 35 is reciprocable in valve body 17 to a closed position wherein imperforate portion 39 is positioned between seats 25 and 27.

Bore 37 is stepped and includes a first portion 41 having a diameter substantially equal to that of downstream seat 27 and a second portion 43 having a diameter substantially equal to that of enlarged diameter portion 29 of upstream seat 25. In the preferred embodiment, first portion 41 and second portion 43 are connected together by a frustoconical portion 45.

Figure 3:
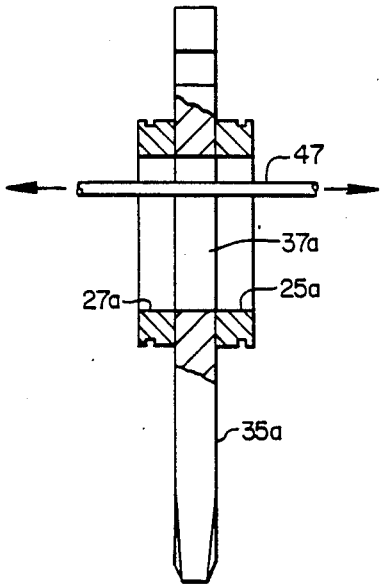
FIG. 3 is a view of the relationship between the seats and gate of a gate valve of the prior art with a wire extending therethrough.
Figure 4:
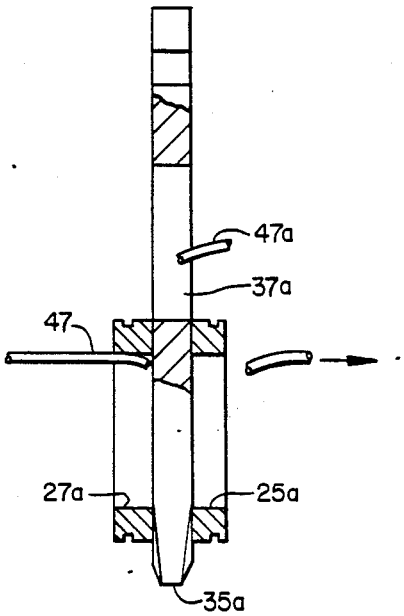
FIG. 4 is a view of the prior art configuration of FIG. 3 with the wire cut.

Referring now to FIGS. 3 and 4, there is illustrated the gate and seat configuration of valves of the prior art. In FIG. 3, there is shown an upstream seat 25*a* and a downstream seat 27*a* with a gate 35*a* therebetween. Seats 25*a* and 27*a* have uniform substantially equal inside diameters. Likewise, gate 35*a* includes a bore 37*a* having a uniform inside diameter substantially equal to those of seats 25*a* and 27*a*. A wire 47 is depicted in FIG. 3 passing through seats 25*a* and 27*a* and bore 37*a*. Wire 47 is in tension, as would be the case during wireline operations.

FIG. 4 depicts the configuration of seats 25*a* and 27*a* with respect to gate 35*a* after gate 35 has moved from the open position of FIG. 3 to the closed position. In order to accomplish such movement, it is necessary that wire 47 be cut. Wire 47 is cut by the shearing action of bore 37*a* as it passes seats 25*a* and 27*a*. Since the diameters of seats 25*a* and 27*a* and bore 37*a* are substantially equal, wire 47 must be sheared simultaneously at two places. Since wire 47 is typically of a very durable material, substantial force is required to accomplish such shearing. Additionally, the portion thereof, designated 47*a*, disposed between seats 25*a* and 27*a* is left behind in the valve body. Portion 47*a* may impair the function of the valve.

Figure 5:
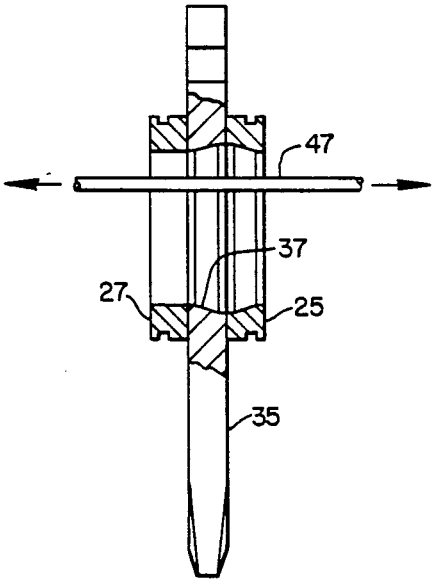
FIG. 5 is a view of the seats and gate of the valve of the present invention in the open position with a wire extending therethrough.
Figure 6:
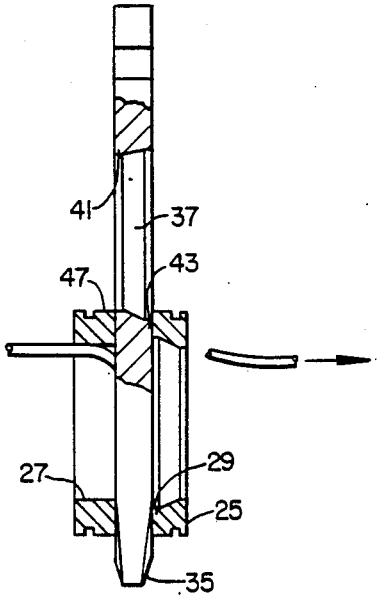
FIG. 6 is a view of the seats and gate of FIG. 5 is the closed position with the wire cut.

Referring now to FIGS. 5 and 6, there is illustrated the operation of the bore and seats of the present invention. In FIG. 5, gate 35 is illustrated in the open position with bore 37 positioned between seats 25 and 27 with a wire 47 under tension passing therethrough. In FIG. 6, gate 35 is shown in the closed position after having sheared wire 47. Since the diameters of downstream seat 27 and first portion 41 of bore 37 are smaller than the diameters of second portion 43 of bore 37 and enlarged diameter portion 29 of upstream seat 25, wire 47 shears at one point between downstream seat 27 and gate 35. Preferably, the diameters of portions 43 and 29 such that wire 47 is cut through completely before it is contacted by portions 29 and 43. It is contemplated that the tension on wire 47 will be such that when wire 47 is cut initially, the tension will pull the upstream portion of wire 47 clear so that the wire is cut only once.

Referring again to FIG. 1, gate 35 is connected to and operated by an actuator shaft 49, which extends outwardly of valve body 17 through a bore 50 of a valve bonnet 51. Valve bonnet 51 is sealingly connected to valve body 17 by a plurality of studs 53.

Figure 2:
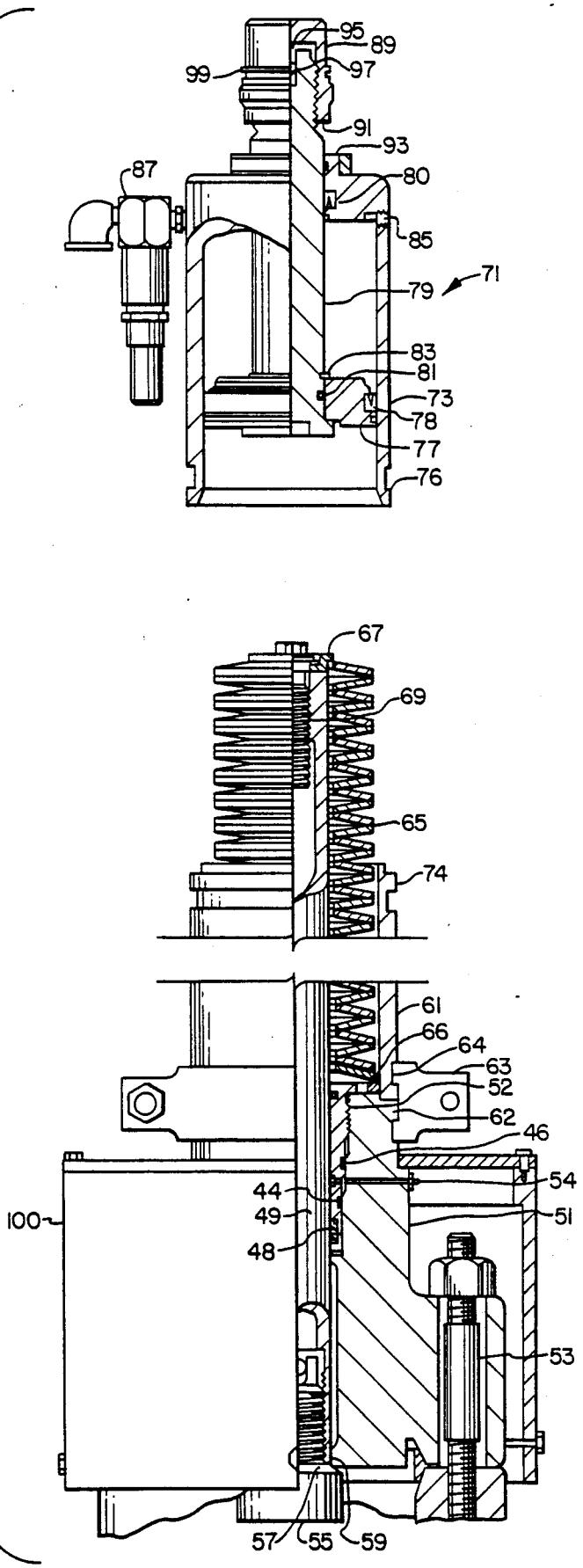
FIG. 2 illustrates the actuator of the present invention with the piston power assembly removed from the actuator housing.

Preferably, the connection between gate 35 and actuator shaft 49 is established by a stem 55 that is threadedly connected with the inner end of actuator shaft 49. Stem 55 is cylindrical and includes a frustoconical sealing portion 57 which is adapted to seat with a seat 59 in bonnet 51 when the valve is in the closed position, as is shown in FIG. 2. Sealing portion 57 and seat 59 thus provide a metal-to-metal seal when the valve is closed.

The sliding seal between actuator shaft 49 and bonnet 51 is established by a packing ring 48 which is carried by a packing retainer 52 that is threadedly engaged with bonnet 51. A lubrication port 54 is provided for introducing a quantity of grease or other suitable lubricant into bonnet 51 and packing retainer 52, thereby to lubricate stem 49. Seal rings 44 and 46 are pr provide for sealing between packing retainer 52 and bonnet 51.

Actuator 15 includes a cylindrical actuator housing 61 which is releasably connected to bonnet 51 by a clamp 63. Clamp 63 has a generally U-shaped cross-section and engages and holds together radially outwardly extending shoulders 62 and 64 formed on bonnet 51 and actuator housing 61, respectively. Clamp 63 includes a pair of semicircular halves that connected together by bolts or the like. Clamp 63 may thus be readily assembled or disassembled with ordinary wrenches, thereby to facilitate the quick and easy installation of housing 61 on bonnet 51.

Actuator 15 includes spring means for urging shaft 49 outwardly with respect to bonnet 51. In the preferred embodiment, the spring means includes a plurality of Bellville washers 65 stacked about actuator shaft 49. The Bellville washers 65 are compressed between a bonnet spacer ring 66 and a spring retainer 67 carried at the end of actuator shaft 49. Spring retainer 67 is connected to actuator shaft 49 by means of a spring compression bolt 69, which is threadedly engaged with the end of shaft 49. The number and size of Bellville washers 65 is selected so as to provide sufficient stroke to move actuator shaft 49 and gate 35 from the open position, as shown in FIG. 1, to the closed position, and to provide sufficient force to shear a wireline even in the absence of valve body pressure. The length of actuator shaft 49 is chosen to be long enough to accommodate the Bellville washers.

Referring particularly to FIG. 2, which shows actuator shaft 49 in the fully outward position, Bellville washers 65 are preloaded so as to provide sufficient force at the end of the stroke of actuator shaft 49 to sever the wireline and also to hold seating portion 57 firmly against seat 59. During assembly, Bellville washers 65 are placed about actuator shaft 49 in an unloaded condition. The preload is then applied by advancing spring compression bolt 69 axially into actuator shaft 49. The stack of Bellville washers 65 can be easily assembled and preloaded by one man. The only tool required is an ordinary wrench.

Actuator shaft 49 is urged inwardly by a piston power assembly, which is designated generally by the numeral 71. Piston power assembly 71 includes a cylindrical body 73 which is releasably connected to actuator housing 61 by a clamp 75 which is similar or identical to clamp 63 and which engages and holds together radially outwardly extending shoulders 74 and 76 formed on ctuator housing 61 and body 73, respectively. A piston assembly, which includes a piston 77 and a piston shaft 79, is slidingly sealingly mounted within body 73. As is best shown in FIG. 2, the sliding seal between piston 77 and body 73 is established by a cup-type seal ring 78 and the sliding seal between piston shaft 79 and body 73 is established by a cup-type seal ring 80. An O-ring 81 is provided to seal between piston shaft 79 and piston 77. Piston 77 is retained on piston shaft 79 by a snap ring 83.

Referring again to FIG. 1, the inner end of piston shaft 79 is adapted to abut with and apply force to actuator shaft 49 through spring retainer 67. The valve opening force is supplied by hydraulic or pneumatic pressure acting on piston 77. The hydraulic or pneumatic pressure is supplied to piston power assembly 71 through an inlet 85. The hydraulic or pneumatic operating pressure and the size of piston 77 are selected to provide sufficient force to overcome the outward forces on actuator shaft 49 caused by valve body pressure and Bellville washers 65. A pressure relief system 87 is provided to prevent over pressure in body 73. When the pneumatic or hydraulic pressure in body 73 is relieved, Bellville washers 65 urge actuator shaft 49 outwardly.

If it is desired to service piston power 71, as for example by replacing any of the seals, piston power assembly 71 may be easily removed by one man simply by disconnected clamp 75. Piston power assembly 71 may be conveniently handled by removing pressure relief system 87 and the hydraulic or pneumatic line (not shown) at inlet 85.

While the overall length of actuator 15 when shaft 49 is in the fully outward position, may be four or five feet, piston power assembly 71 can be removed with as little as two inches of clearance. For example, if actuator 15 were positioned to extend horizontally toward a bulkhead, the bulkhead could be as little as two inches from the end of the fully extended piston shaft 79. In such circumstances, piston power assembly 71 could be removed by disconnecting clamp 75 and pulling piston power assembly 71 outwardly until the end of piston downstop cap 89 abuts the bulkhead. Then, body 73 may be slid outwardly along piston shaft 79 until clear of actuator shaft 49.

Actuator 15 includes external means for adjusting the drift of valve 13 such that bore 37 of gate 35 is precisely aligned with flowway 23. Such alignment is critical in wireline operations in order that valve 13 provide a full bore opening for the passage of tools therethrough.

The external drift adjustment means includes a cap 89 threadedly engaged with the outer end of piston shaft 79. Referring specifically to FIG. 2, cap 89 includes a shoulder 91 that is abuttable with a shoulder 93 formed on body 73 of piston power assembly 71. The abutment of shoulder 91 with shoulder 93 limits the inward travel of piston shaft 79 and thereby limits the inward travel of actuator shaft 49 and gate 35. Cap 89 is movable inwardly and outwardly along piston shaft 79 on the threads. Preferably, means are provided for locking cap 89 on piston shaft 79. The locking means includes a slot 95 formed in the end of piston shaft 79 which engages a pin 97, which is inserted through cap 89. Pin 97 is preferably held in position by a snap ring 99. Cap 89 is thus effectively adjustable in half turn increments along the length of the threaded end portion of shaft 79.

Actuator 15 preferably includes a bonnet shroud 100. Bonnet shroud 100 is a cylindrical structure positioned about bonnet 51. Bonnet shroud 100 serves to protect the studs 53 from radiation or flame impingement during fires. Such radiation or impingement could impair the connection between bonnet 51 and valve body 15. Bonnet shroud 15 thus enhances the fire-safety of the valve.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many as possible embodiments may be made of the invention without departing from the scope thereof, it is to be understood that all matter herein set forth or shown in the accompany drawings is to be interpreted as illustrative and not in a limiting sense.

What is claimed is:

1. A wireline cutting actuator and valve assembly adapted to close automatically and sever a wireline in the valve as the valve is operable toward the valve closed position, which comprises:

a valve body including an inlet port and an outlet port with a flowway therebetween for extending a wireline therethrough;

a first annular seat positioned in said flowway, said first seat having a first predetermined inside diameter;

a second annular seat positioned in said flowway axially aligned with and spaced apart from said first annular seat, said second seat having a second predetermined inside diameter greater than said first inside diameter of said first seat;

a gate positioned between said first and second seats, said gate including a bore and an imperforate portion adjacent said bore, said gate being movable generally perpendicular to said flowway between a valve closed position wherein said imperforate portion is positioned between and in sealing engagement with at least one of said first and second seats and a valve open position wherein said bore is positioned between said first and second seats, said gate bore having a first inside diameter adjacent said first seat substantially equal to said first inside diameter of said first seat, and said gate bore having a second inside diameter adjacent said second seat substantially equal to said second inside diameter of said second seat, said first seat and first inside diameter of said gate bore cooperating to sever a wireline in said flowway at only one location as said gate moves from said valve open position to said valve closed position;

a bonnet connected to said valve body, said bonnet including a bonnet bore;

an actuator shaft extending outwardly of said bonnet through said bonnet bore, said actuator shaft having an inner end with means for connecting said inner end to said gate, and an outer end displaced from said gate, said actuator shaft including a sealing portion defined on said shaft which cooperates with said bonnet to limit outward movement of said actuator shaft with respect to said bonnet;

a plurality of disk springs stacked about said actuator shaft and operable when compressed to urge said actuator shaft outwardly with respect to said bonnet;

spring compression means connected to the outer end of said actuator shaft for compressing said plurality of disk springs;

an actuator housing releasably connected to said bonnet and positioned about said actuator shaft and said plurality of disk springs;

and a piston power assembly removably connected to said actuator housing, said piston power assembly including:

(a) a piston housing releasably connected to said actuator housing;

(b) a piston slidingly mounted in said piston housing and abuttable with the outer end of said actuator shaft and operable when power energized to urge said shaft inwardly with respect to said bonnet, said piston being removable from said actuator shaft with said piston housing;

(c) and a piston shaft inward and outwardly movable with said piston and extending outwardly of said piston housing.

2. A wireline cutting valve adapted to sever a wireline in the valve as the valve is operative from the valve open position to the valve closed position which comprises:

a valve body including an inlet port and an outlet port with a flowway therebetween for extending a wireline therethrough;

a first annular seat positioned in said flowway, said first seat having a first predetermined inside diameter;

a second annular seat positioned in said flowway axially aligned with and spaced apart from said first annular seat, said second seat having a second predetermined inside diameter greater than said first inside diameter of said first seat;

a gate positioned between said first and second seats, said gate including a bore and an imperforate portion adjacent said bore, said gate being movable generally perpendicular to said flowway between a valve closed position wherein said imperforate portion is positioned between and in sealing engagement with at least one of said first and second seats and a valve open position wherein said gate bore is positioned between said first and second seats, said gate bore having a first inside diameter adjacent said first seat substantially equal to said first inside diameter of said first seat, and said gate bore having a second inside diameter said second seat substantially equal to said second inside diameter of said second seat, said gate when moved from said valve open position to said valve closed position effecting a crossing of said first inside diameter of said bore past said first seat before said second inside diameter of said bore crosses said second seat to sever a wireline in said flowway only at the crossing location of said first gate bore diameter and said first seat;

a bonnet connected to said valve body, said bonnet including a bonnet bore;

and a shaft connected to said gate and extending outwardly of said valve bonnet through said bonnet.

3. The valve as claimed in claim 2, wherein said first seat has an internal cylindrical bore having a uniform inside diameter.

4. The valve as claimed in claim 3, wherein said second seat has an internal frustoconical bore having a minimum inside diameter substantially equal to the inside diameter of said first seat.

5. The assembly as claimed in claim 2, wherein said bore of said gate includes a frustoconical portion having a maximum inside diameter substantially equal to said inside diameter of said second seat and a minimum inside diameter substantially equal to said inside diameter of said first seat.

6. The assembly as claimed in claim 2, wherein said first seat is positioned between said gate and said inlet and said second seat is positioned between said gate and said outlet.

7. A bonnet and actuator assembly for use with a valve which includes a valve body and a valve member, which comprises:

a bonnet adapted for connection to the valve body;

an actuator shaft extending from an inner end adapted for connection to the valve member to an outer end displaced from the valve member, said actuator shaft being slidable and sealingly extending outwardly of said bonnet and including means formed on said shaft defining a sealing portion which cooperates with said bonnet to limit outward movement of said actuator shaft with respect to said bonnet;

a plurality of disk springs stacked about said actuator shaft and operable when compressed to urge said actuator shaft outwardly with respect to said bonnet;

spring compression means connected to the outer end of said actuator shaft for compressing said plurality of disk springs;

an actuator housing releasably connected to said bonnet and positioned about said actuator shaft and said plurality of disk springs;

and a piston power assembly removably connected to said actuator housing, said piston power assembly including:

(a) a piston housing releasably connected to said actuator housing;

(b) a piston slidingly mounted in said piston housing and abuttable with the outer end of said actuator shaft and operable when power energized to urge said actuator shaft inwardly with respect to said bonnet, said piston being removable from said actuator shaft with said piston housing;

(c) and a piston shaft inwardly and outwardly movable with said piston and extending outwardly of said piston housing.

8. The assembly as claimed in claim 7, including a fire shroud positioned about said bonnet.

9. The assembly as claimed in claim 7, wherein said actuator shaft includes:

an internally threaded bore adjacent the outer end thereof;

a spring compression bolt threadedly engaged with said internally threaded bore of said actuator shaft;

and a spring retainer carried by said spring compression bolt.

10. The assembly as claim in claim 7, wherein:

said bonnet includes a radially outwardly extending shoulder adjacent its outer end;

said actuator housing includes a radially outwardly extending shoulder adjacent its inner end;

and said bonnet and actuator housing are releasably connected together by clamp means for engaging said shoulders.

11. The assembly as claimed in claim 10, wherein said clamp means includes a pair of semicircular halves and means for holding said halves together.

12. The assembly as claimed in claim 7, wherein:

said actuator housing includes a radially outwardly extending shoulder adjacent its outer end;

said piston housing includes a radially outwardly extending shoulder adjacent its inner end;

and said actuator housing and piston housing are releasably connected together by clamp means for engaging said shoulders.

* * * * *